United States Patent [19]

Sasayama et al.

[11] 4,452,210

[45] Jun. 5, 1984

[54] FUEL INJECTION VALVE DRIVE CIRCUIT

[75] Inventors: Takao Sasayama, Hitachi; Kazuo Kato, Ibaraki, both of Japan

[73] Assignee: Hitachi, Ltd., Tokyo, Japan

[21] Appl. No.: 420,885

[22] Filed: Sep. 21, 1982

[30] Foreign Application Priority Data

Sep. 21, 1981 [JP] Japan ..... 56-147852

[51] Int. Cl.[3] ..... F02B 3/00

[52] U.S. Cl. ..... 123/490; 361/154

[58] Field of Search ..... 123/490; 361/154

[56] References Cited

U.S. PATENT DOCUMENTS 4,180,026 12/1979 Schulzke ..... 123/490
4,225,898 9/1980 Weber ..... 361/154
4,234,903 11/1980 Harper ..... 123/490
4,295,177 10/1981 Woodhouse ..... 361/154
4,300,508 11/1981 Streit ..... 123/490
4,328,526 5/1982 Dilger ..... 361/154
4,347,544 8/1982 Ohba ..... 361/154

*Primary Examiner*—Ronald B. Cox
*Attorney, Agent, or Firm*—Antonelli, Terry & Wands

[57] ABSTRACT

Disclosed is a fuel injection valve drive circuit for use in an internal combustion engine wherein the excitation current supplied to the fuel injection valve winding is controlled on a feedback basis so as to maintain the specified value during the period of the valve opening command signal. A control signal based on the difference between the signal representing the excitation current and the reference signal is produced, and the excitation current is controlled by the pulse width modulation signal which is produced based on the magnitude of the control signal.

8 Claims, 6 Drawing Figures

Vi
VR2
VR1
Vc

0

Vo
t0
t1
t2
t3
t4
t5
t6

FUEL INJECTION VALVE DRIVE CIRCUIT

The present invention relates to a fuel injection valve drive circuit and, particularly, to an improved fuel injection valve drive circuit suitable for high-speed driving of an electromagnetic valve used in a fuel injector of an internal combustion engine.

The fuel injection valve operates to move its plunger in response to the opening command signal which is generally formed in a rectangular pulse so that the valve opens for the duration of the pulse. However, the opening operation by the plunger is attended by a certain time lag and also causes a bounce of the plunger as it hits the stopper when the valve operates to fully open. In addition, the closing operation at the end of the opening command signal is also attended by a certain time lag and causes a bounce of the plunger as it hits the valve seat when the valve is closed. Therefore, in performing control of the valve opening duration so as to obtain the desired air-fuel ratio by the fuel injector, accurate fuel injection control cannot be achieved.

In order to solve the above-mentioned problems, there have been proposed the following methods.

In opening the fuel injection valve, a higher voltage is applied to the winding of the valve during an initial short period of the opening signal so that the excitation current rises sharply, or a preliminary current which is not large enough to activate the valve is conducted to the winding in advance so that the valve responds to the command signal quickly. In closing the fuel injection valve, an inverse current is conducted to the winding which has been supplied with the minimum retention current while the valve is open so that the residual magnetic flux is cancelled, thereby advancing the closing operation of the valve.

According to a typical fuel injection valve drive circuit employing the above-mentioned prior art methods as disclosed in U.S. Pat. No. 4,180,026 and Japanese Patent Laid-open No. 55-46091, the arrangement is made such that the excitation current of the valve rises sharply when the valve is opended and the minimum retention current is supplied to the valve winding after the valve has opended so that the effect of the residual magnetic flux is small when the valve is closed. In this circuit arrangement, the valve excitation current is controlled on a feedback basis so as to maintain the specified value.

It is an object of the present invention to provide an improved fuel injection valve drive circuit wherein the valve excitation current is controlled on a feedback basis so as to obtain the specified value.

According to the present invention, during the open period of the fuel injection valve, the valve excitation current is detected and a signal representing thereof is produced, a control signal based on the difference between the current signal and a predetermined reference signal is produced, a pulse-width modulation signal based on the magnitude of the control signal is produced, and the valve excitation current is controlled by the pulse-width modulation signal.

These and other objects and features of the present invention will become more apparent from the following detailed description taken in conjunction with the accompanying drawings in which.

An embodiment of the present invention will now be described with reference to the drawings.

Figure 1:
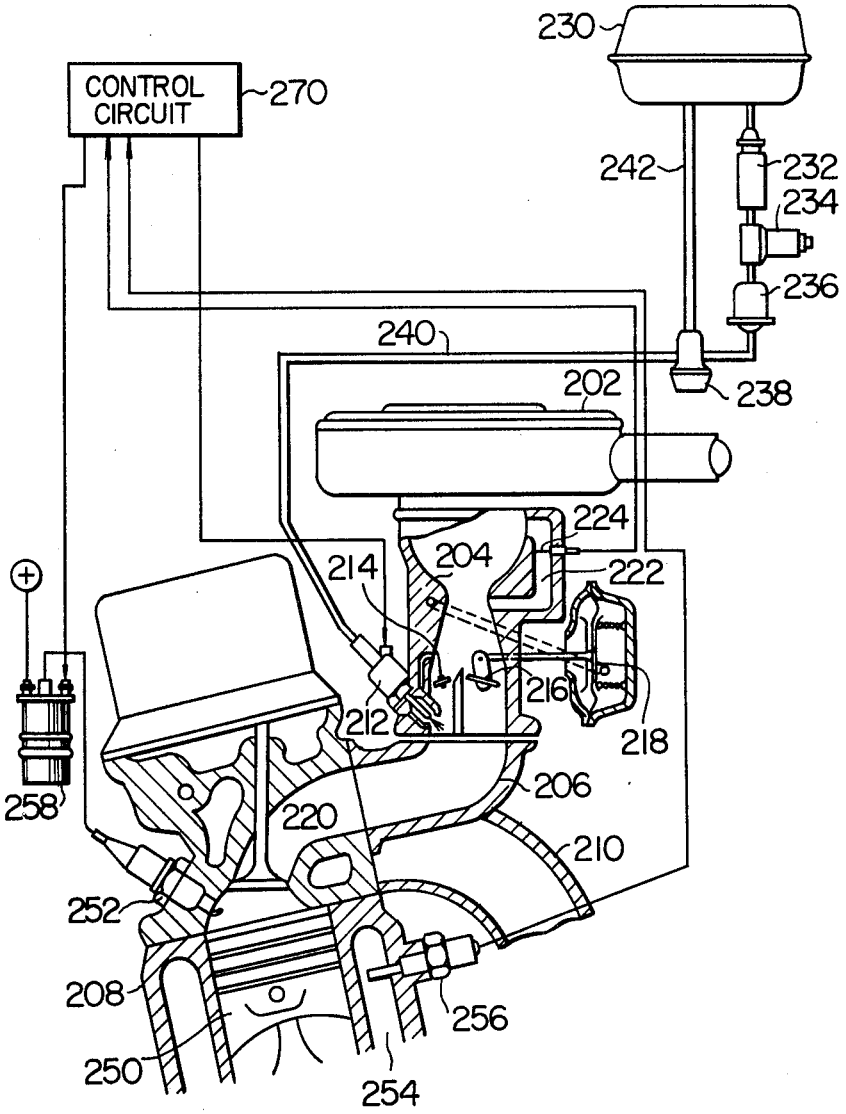
FIG. 1 is a systematic diagram of the internal combustion engine with the fuel injection valve drive circuit according to the present invention applied thereto.

FIG. 1 shows the control system of the engine to which the inventive fuel injection valve drive circuit is applied. Intake air is conducted through air cleaner 202, throttle chamber 204 and inlet pipe 206 to cylinder 208. The exhaust gas from the cylinder 208 is evacuated through exhaust pipe 210 to the atmosphere.

The throttle chamber 204 is provided with a fuel injector 212, and the fuel injected from the injector 212 is atomized in the air flow path in the throttle chamber 204 so that the air-fuel mixture is formed. The mixture is then supplied through the inlet pipe 206 and inlet valve 220 into the cylinder 208. The circuit of the present invention is used to drive an electromagnetic valve which constitutes the injector 212.

In proximity to the outlet of the injector 212, there are provided throttle valves 214 and 216. The throttle valve 214 is arranged so that it is moved in association with the accelerator pedal operated by the driver, while the throttle valve 216 is driven by diaphragm 218 such that it is closed completely when the air flow is small and as the air flow increases, causing an increasing back pressure to the diaphragm 218, it opens proportionally so as to reduce the intake resistance.

On the upstream side of the throttle valves 214 and 216 in the throttle chamber 204 is provided an air flow path 222, in which is provided an electrical heating element 224 providing an electrical signal which is based on the relationship between the air flow speed and the amount of heat dissipation and varies depending on the air flow speed. Since the heating element 224 is located inside the air flow path 222, it is protected from back fire which sends back a high temperature gas from the cylinder 208 and also from being contaminated by dusts included in the intake air. The air flow path 222 has its outlet opening in the neighborhood of the throat section of the Venturi tube and its inlet opening on the upstream side of the Venturi tube.

The fuel is supplied from fuel tank 230 through fuel damper 234 and filter 236 to a fuel pressure regulator 238, then the pressurized fuel is supplied through pipe 240 to the injector 212. The fuel pressure regulator 238 returns part of the fuel through return pipe 242 to the fuel tank 230 so that the difference of the air pressure in the inlet pipe 206 and the fuel pressure in the injector 212 is maintained constant.

The mixture taken into the cylinder 208 through the inlet valve 220 is compressed by piston 250, then ignited by spark plug 252. The cylinder 208 is cooled by the coolant water in water jacket 254, and the temperature of the water is measured by coolant thermal sensor 256. The spark plug 252 is applied with a high voltage by ignition coil 258 at a proper ignition timing.

Although it is not shown in the figure, there is further provided a crank angle sensor which provides a reference angle signal at the reference angular position of the engine crank shaft and crank position signals at a certain interval (e.g., 0.5°) of the crank shaft rotation.

The output signals from the crank angle sensor, the coolant thermal sensor 255 and the heating device 224 are sent to control circuit 270 including a microcomputer. The control circuit 270 processes the input signals and provides the outputs for activating the injector 212 and the ignition coil 258.

Figure 2:
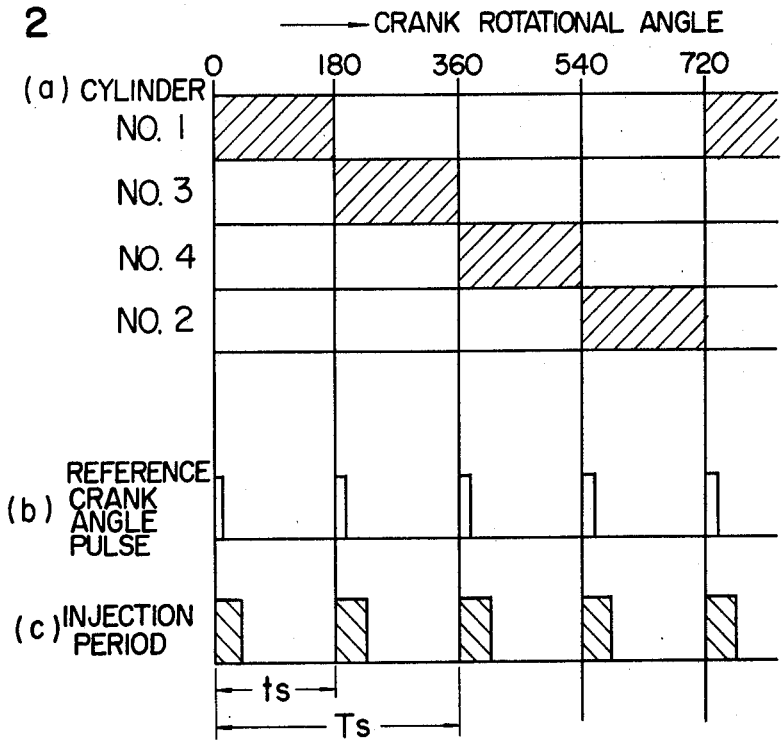
FIG. 2 is a timing chart exemplifying the operational cycle of the internal combustion engine shown in FIG. 1.

FIG. 2 shows the timing of fuel injection by the injector for a four-cylinder engine. The horizontal axis of the diagram represents the rotational angle of the crank shaft, and the intake stroke of each cylinder is shown by hatching. As can be seen from the diagram, the intake stroke occurs at every 180° of the crank shaft, section of 0°–180° being for the first cylinder, 180°–360° for the third cylinder, 360°–540° for the fourth cylinder, and 540°–720° for the second cylinder.

The reference crank position pulse is generated at every 180° of the crank angle as shown in FIG. 2(*b*), and the injector 212 is activated in response to the reference pulse for a duration determined by the processing of the control circuit 270 based on the measurement signals. The fuel injection period, i.e., the time width in which the injection valve 212 opens, is shown in FIG. 2(*c*).

Figure 3:
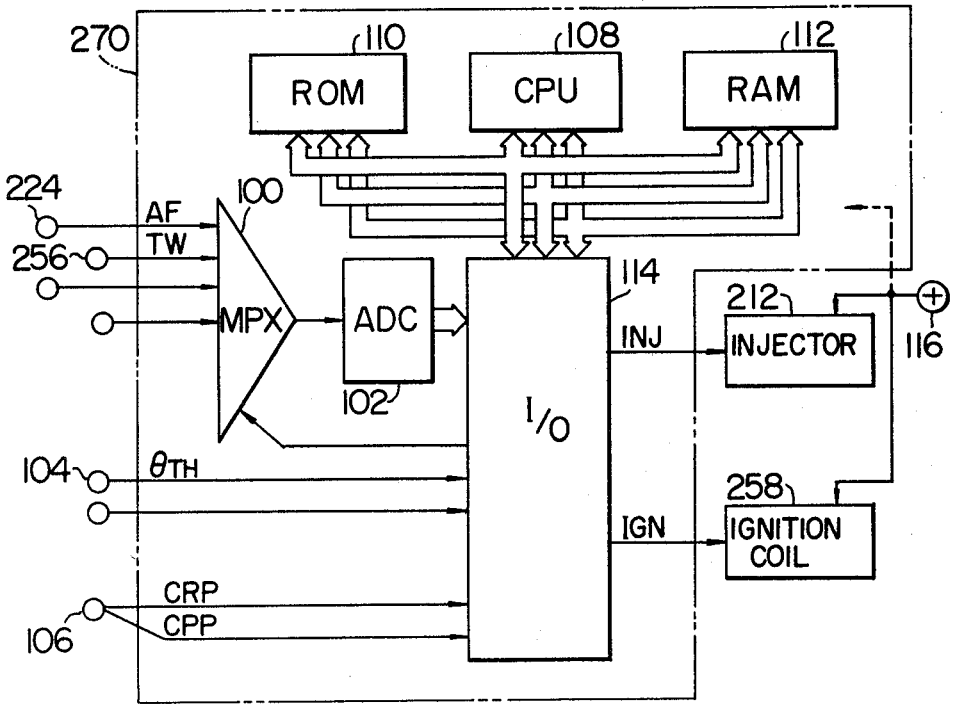
FIG. 3 is a block diagram showing in detail the control circuit shown in FIG. 1.

FIG. 3 shows the detailed block diagram of the control circuit 270 shown in FIG. 1. The circuit receives three types of signals. The first type is analog signal including output AF of the sensor 224 for measuring the intake air flow, and output TW of the sensor 256 for measuring the coolant temperature. These analog signals are received by multiplexer (MPX) 100, which transfers the sensor outputs to analog-to-digital converter (ADC) 102 one at a time on a time slice basis, and the analog signals are transformed into digital data. The second type of signal is two-state signal including signal $\theta_{TH}$ which is produced by switch 104 operating in response to the movement of the throttle valve and represents the full-open state of the throttle valve. This type of signal can be treated as a 1-bit digital signal. The third type of signal is the pulse train including the reference crank position signal (will be termed CRP) and the crank position pulse signal (will be termed CPP) produced by the crank angle sensor 106. The CRP is produced at every 180°, 120° or 90° of the crank angle for an engine having four cylinders, six cylinders or eight cylinders, respectively. The CPP is produced, for example, at every 0.5° of the crank angle.

CPU 108 is a central processing unit for performing digital computation, ROM 110 is a storage unit for storing the control program and fixed data, and RAM 112 is a storage unit accessible in both reading and writing. Input/output interface circuit 114 receives signals from the A/D converter and the sensors 104 and 106, and transfers the signals to the CPU 108. The interface circuit 114 also transfers signals INJ and IGN from the CPU 108 to the injector 212 and the ignition coil 258, respectively. Power is supplied from power terminal 116 to each circuit block in the control circuit 270, however it is not shown in the figure for purposes of simplicity. The injector 212 has a winding for activating the valve and the ignition coil 258 has a primary winding for storing electromagnetic energy. One ends of these windings are connected to the power terminal 116 and the other ends are connected to the I/O interface circuit 114 so that the currents to the injector 212 and ignition coil 258 are controlled.

The injector 212 is made up of a fuel injection valve and its drive circuit.

The following will describe the fuel injection valve drive circuit according to the present invention.

Figure 4:
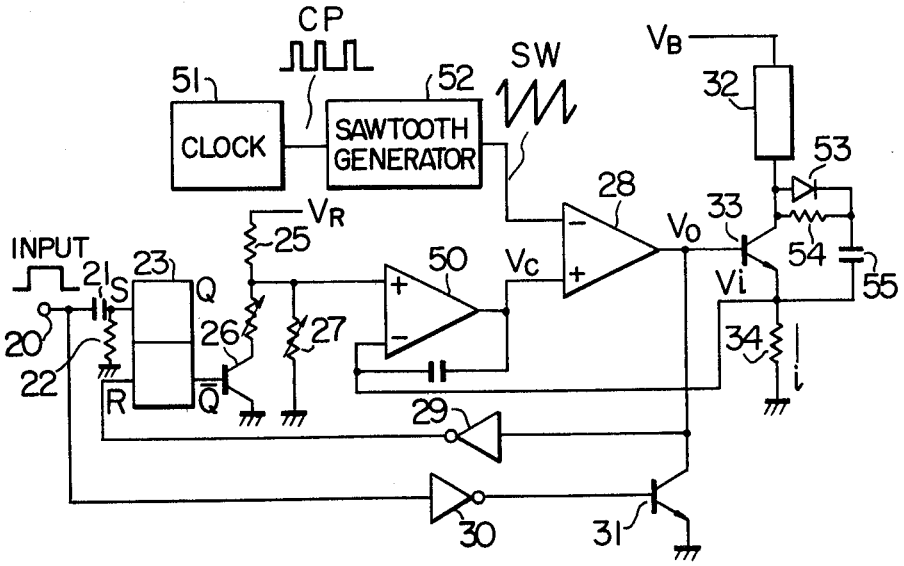
FIG. 4 is a schematic diagram showing the inventive fuel injection valve drive circuit.

In FIG. 4, input terminal 20 is connected through capacitor 21 to one terminal of resistor 22 and the set (S) input of flip-flop 23. Another terminal of the resistor 22 is grounded. The output ($\overline{Q}$) of the flip-flop 23 is connected to the base of NPN transistor 24, whose emitter is grounded and collector is connected through variable resistor 26 to resistor 25, variable resistor 27 and the positive input of integrator 50. The resistor 25 receives a constant voltage $V_R$ at one terminal and another terminal of the variable resistor 27 is grounded. The negative input of the integrator 50 is grounded through a resistor 34 and at the same time connected through an integrating capacitor 49 to the output of the integrator 50. The integrator 50 with its associated capacitor 49 may be replaced with a differential amplifier. The output of the integrator 50 is connected to the positive input of comparator 28. Clock generator 51 provides clock pulses CP in a certain frequency for saw tooth wave generator 52. The saw tooth wave generator 52 produces a saw tooth wave SW in synchronization with the clock pulses CP, and supplies the output to the negative input of the comparator 28. The output of the comparator 28 is connected to the base of NPN transistor 33 and the collector of NPN transistor 31. The collector of the NPN transistor 33 is connected to injection valve winding 32, the anode of diode 53 and resistor 54. Another end of the injection valve winding is connected to battery power source $V\underline{B}$. The cathode of the diode 53 and another end of the resistor 54 are commonly connected through capacitor 55 to the node of the emitter of the NPN transistor 33 and resistor 34. The emitter of the NPN transistor 31 is grounded and its collector is connected to the output of the comparator 28 and at the same time connected through an inverter 29 to the reset (R) input of the flip-flop 23. The input terminal 20 is connected through an inverter 30 to the base of the NPN transistor 31.

Figure 5:
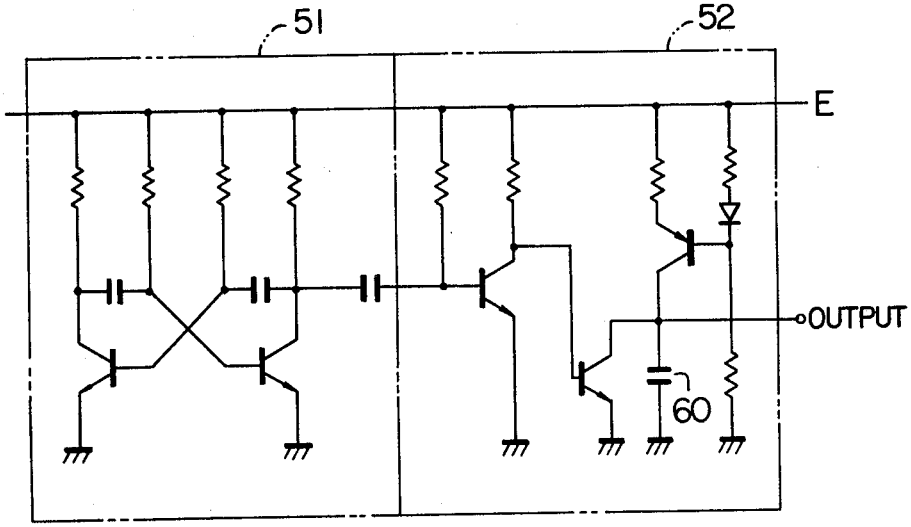
FIG. 5 is a detailed schematic diagram of the clock generator and the saw tooth wave generator shown in FIG. 4.

FIG. 5 shows detailed circuit diagrams of the clock generator 51 and saw tooth wave generator 52. The clock generator is of a well known astable multivibrator and provides the clock pulses CP shown in FIG. 4. The saw tooth wave generator 52 is also a well known circuit, in which capacitor 60 is charged by a constant current and discharged in response to the clock pulses CP so that a saw tooth wave is produced across the capacitor 60.

Figures 6A, 6B, 6C, 6D, 6E, 6F, 6G:
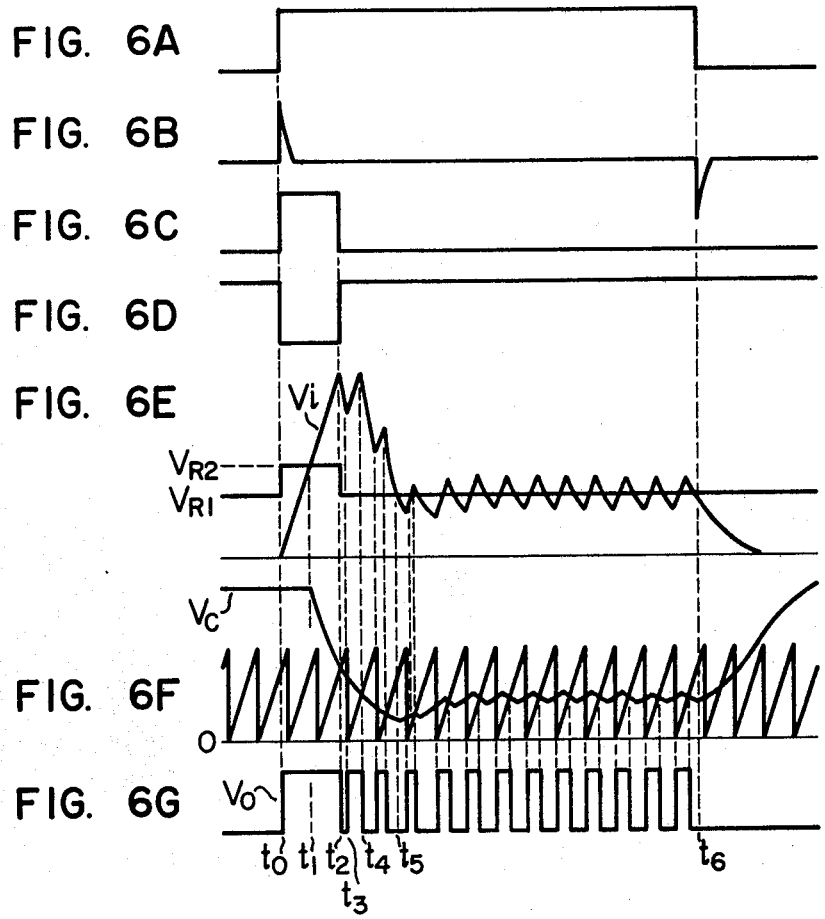
FIGS. 6A through 6G are waveform diagrams showing the voltage waves observed in various portions of the circuit shown in FIG. 4.

In the foregoing arrangement, when a valve opening command signal shown in FIG. 6A is given to the input terminal 20, a pulse signal shown in FIG. 6B is applied to the set (S) input of the flip-flop 23 and it is set as shown in FIG. 6C. The output $\overline{Q}$ of the flip-flop 23 provides the inverted output of the signal of FIG. 6C as shown in FIG. 6D, and this low level signal cuts off the NPN transistor 24. Then the positive input of the integrator 50 is set to a high reference voltage $V_{R2}$ shown in FIG. 6E. At the same time, the high input signal at the input terminal 20 is inverted by the inverter 30, and its low output is applied to the base of the NPN transistor 31 and it is cut off. Consequently, the output of the comparator 28 is released from being grounded. However, at the rise of the input signal, no current flows through the resistor 34, and the negative input of the integrator 50 remains low, causing the integrator 50 to provide the highest integral output. Accordingly, the positive input of the comparator 28 receives a positive control signal $V_C$ having a magnitude sufficiently higher than the saw tooth wave applied to the its negative input, as shown in FIG. 6F, and the output of the comparator 28 goes high at $t_o$ when the valve opening command signal rises, causing the NPN transistor 33 to become conductive. In consequence, the current starts flowing through the injection valve winding 32 and increases in accordance with the time constant determined by the inductance of the winding and the resistor 34. The current i flowing through the winding is detected as a voltage $V_i$ across the resistor 34 and it is applied to the negative input of the integrator 50. The current signal $V_i$ rises sharply as shown in FIG. 6E, and when it exceeds the reference signal $V_{R2}$ applied to the positive input of the integrator 50 at $t_1$, the output $V_C$ of the integrator 50 decreases as shown in FIG. 6F. Then at $t_2$ when the control signal $V_C$ first falls below the saw tooth wave, the output $V_O$ of the comparator 28 goes low as shown in FIG. 6G. At this time, the flip-flop 23 receives at its reset (R) input a high reset signal through the inverter 29 and it is reset. Thus the flip-flop 23 makes a transition at $t_2$ as shown in FIGS. 5C and 5D, causing the transistor 24 become conductive. Then the reference voltage supplied to the positive input of the integrator 50 alters to a low reference voltage $V_{R1}$. Also at $t_2$ the NPN transistor 33 is cut off, and the current in the winding 32 flows through the diode 53 and resistor 34 and charges the capacitor 55. During the charging period, the current in the winding decreases as shown by $V_i$ in FIG. 6E. The control signal $V_C$ exceeds the saw tooth wave again at $t_3$ as shown in FIG. 6F, causing the output of the comparator 28 to go high and the transistor 33 to be conductive, and the current in the winding will increase. At $t_4$ the output of the comparator 28 goes low again, causing the transistor 33 to be cut off, and the current in the winding will decrease. In this way, the current decreases gradually and the comparator 28 provides a pulse-width modulation signal in which the pulse width decreases along with the decreasing current as shown in FIG. 6G.

As the excitation current decreases, the current signal $V_i$ also goes down, and when it coincides with the reference signal $V_{R1}$ at $t_5$ as shown in FIG. 6E, the output of the integrator 50 turns to increase. The excitation current, i.e., the current signal $V_i$, increases during the high period of the pulse-width modulation signal and decreases during the low period of the signal as shown in FIG. 6E. Further, the control signal $V_C$ decreases when the current signal $V_i$ is larger than the reference signal $V_{R1}$ and increases by the opposite relation. In consequence, the excitation current, i.e., the current signal $V_i$, is controlled on a feedback basis so that it coincides with the reference signal $V_{R1}$ as shown in FIG. 6E. On this account, even if the power voltage $V_B$ varies significantly, the pulse-width of the pulse-width modulation signal is controlled so that the current in the winding maintains a constant value corresponding to the reference signal $V_{R1}$. The reference signal $V_{R1}$ can be varied by adjusting the variable resistor 26. The variable resistor 27 is used to adjust the magnitude of the excitation current in the initial period of the valve opening operation.

At $t_6$ when the valve opening command signal falls, the low signal is inverted by the inverter 30 and applied to the base of the transistor 31. Then the transistor 31 becomes conductive, pulling the output of the comparator 28 to a low level. Then the transistor 33 is kept cut-off and the excitation current, i.e., the current signal $V_i$, decrease to zero as shown in FIG. 6E, and the output $V_c$ of the integrator 50 increases upto the highest integral output as shown in FIG. 6F.

The foregoing sequence of operation takes place each time the valve opening command signal is issued. As will be understood from FIG. 6E, the excitation current, i.e., the current signal $V_i$, takes a large value in the initial period of the valve opening operation, and then it is controlled to maintain the minimum retention current in accordance with the reference signal $V_{R1}$. Thus, the fuel injection valve drive circuit which is highly responsive to the valve opening command signal is achieved.

When the current is conducted through the valve winding intermittently, the back electromotive force induced across the winding needs to be absorbed by some means. In the conventional self-oscillating chopper control, a fly-wheel circuit connected in parallel to the injection valve winding 32 has been used to shunt the inductive current in the winding. However, such fly-wheel circuit conducts the current in the same magnitude as that flowing in the winding, resulting in a large power consumption and also a large heat dissipation by the resistor in the fly-wheel circuit. In addition, a large current conductive element is required in the fly-wheel circuit. The present invention employs the external synchronizing system operating in relatively high frequency, which allows a small current variation in each chopping operation, and the resultant small fly-wheel current can be bypassed through the small capacitor 55 to the resistor 34. The capacitor 55 is discharged through the resistor 54 each time the NPN transistor 33 is made conductive. In consequence, the circuit can be operated by the single power transistor, and the resistor in the fly-wheel circuit for absorbing energy in the winding can be eliminated.

According to the present invention, as described above, a satisfactory injection valve drive control can be carried out by using only one power transistor.

In the arrangement of FIG. 4, the capacitor 55 may be replaced with a zener diode. The saw tooth wave produced by the saw tooth wave generator 52 may vary non-linearly, instead of varying linearly.

We claim:

1. A fuel injection valve drive circuit comprising an output circuit for supplying current to a fuel injection valve winding, a detection circuit for detecting the current supplied to said fuel injection valve winding and providing a current signal, a reference signal generating circuit for producing a certain reference signal, a control circuit for controlling said output circuit basing on the difference between said current signal provided by said detection circuit and said reference signal provided by said reference signal generating circuit, and a valve opening command circuit which activates said output circuit only during the period of a valve opening command to said fuel injection valve, characterized in that said control circuit comprises a first circuit for producing a control signal basing on the difference between the current signal provided by said detection circuit and the reference signal provided by said reference signal generating circuit and a second circuit for producing a pulse width modulation signal in accordance with the magnitude of the control signal provided by said first circuit, said output circuit being driven by the pulse width modulation signal provided by said second circuit, wherein said second circuit comprises a circuit for generating a periodic wave signal having a predetermined frequency, and a comparator which compares the periodic wave signal provided by said periodic wave generting circuit with the control signal provided by said first circuit and provides a pulse width modulation signal depending on the magnitude of said control signal.

2. A fuel injection valve drive circuit according to claim 1, wherein said periodic wave generating circuit comprises a circuit for generating a saw tooth wave signal having wherein said certain frequency, and a comparator compares the saw tooth wave signal provided by said saw tooth wave generating circuit with the control signal provided by said first circuit and provides a pulse width modulation signal depending on the magnitude of said control signal.

3. A fuel injection valve drive circuit according to claim 2, wherein said saw tooth wave generating circuit comprises a clock generator for generating clock pulses having a certain frequency, and a saw tooth wave generator for producing a saw tooth wave signal in response to clock pulses provided by said clock generator.

4. A fuel injection valve drive circuit according to one of claims 1, 2 or 3, wherein said first circuit comprises an integrating circuit which integrates the difference between the current signal provided by said detection circuit and the reference signal provided by said reference signal generating circuit.

5. A fuel injection valve drive circuit according to claim 1, wherein said output circuit comprises a switching element which is connected in series with said fuel injection valve winding between power terminals and operated to be conductive or non-conductive in accordance with the pulse width modulation signal provided by said second circuit, and a charging and discharging circuit including a capacitor connected in parallel to said switching element.

6. A fuel injection valve drive circuit according to claim 1, wherein said reference signal generating circuit produces a first reference signal for supplying current to said fuel injection valve winding sufficient to open said valve quickly at the beginning of the opening, and a second reference signal for supplying current to said fuel injection valve winding necessary to hold the open state of said valve after said valve has opended.

7. A fuel injection valve drive circuit according to claim 6, wherein said reference signal generating circuit comprises a constant voltage source, a voltage division resistor circuit which is connected between terminals of said constant voltage source and provides said first or second reference signal, a switching element which selectively sets said first or second reference signal by changing the division ratio of said voltage division resistor circuit, and switching circuit which operates on said switching element to reset from said first reference signal to said second reference signal when the pulse width modulation signal provided by said second circuit has first reached a level for deactivating said output circuit after the current supply to said fuel injection valve winding had started.

8. A fuel injection valve drive circuit according to claim 7, wherein said switching circuit comprises a flip-flop which is set at the leading edge of said valve opening command signal and reset when said pulse width modulation signal has first reached said output circuit deactivating level after said valve had opened, said switching element being operated to provide said first reference signal during the set period of said flip-flop.

* * * * *